US006158175A

United States Patent [19]

Carter

[11] Patent Number: 6,158,175

[45] Date of Patent: Dec. 12, 2000

[54] SUNLIGHT REFRACTIVE COVER FOR AN OUTDOOR AIR CONDITIONING UNIT

[76] Inventor: Loretta L. Carter, 236 McFarland, #98 Pioneer Trailer Park, Indian Springs, Nev. 89018

[21] Appl. No.: 09/046,868

[22] Filed: Mar. 24, 1998

[51] Int. Cl.[7] ..... E04H 1/00

[52] U.S. Cl. ..... 52/79.5; 52/3; 52/23; 52/799.1; 52/71

[58] Field of Search ..... 52/791.1, 799.1, 52/799.12, 3, 23, 71, DIG. 13, 79.5, 79.1; 220/4.02, 484, 4.33, 4.28; 160/352, 351; 135/87, 91

[56] References Cited

U.S. PATENT DOCUMENTS

| | | | |
|---|---|---|---|
| 39,954 | 9/1863 | Powell et al. | 135/87 |
| 364,415 | 6/1887 | Hooper | 135/87 |
| 623,445 | 4/1899 | Van Tuyl | 135/87 |
| 645,656 | 3/1900 | Wynkoop | 135/87 |
| 810,788 | 1/1906 | Moseley | 135/87 |
| 1,409,609 | 3/1922 | Stockle | 135/91 |
| 2,051,643 | 8/1936 | Morrison | 135/87 |
| 2,120,861 | 6/1938 | Hastings | 135/87 |
| 2,155,330 | 4/1939 | Pottenger | 135/87 |
| 2,162,523 | 6/1939 | Blood et al. | 52/71 |
| 2,652,845 | 9/1953 | O'Neill | 135/87 |
| 2,720,236 | 10/1955 | Hoffman . | |
| 2,914,075 | 11/1959 | Wells et al. | 135/5 |
| 2,941,380 | 6/1960 | Garred | 52/3 |
| 3,321,864 | 5/1967 | Stasiuk | 52/71 |
| 4,028,855 | 6/1977 | Prewer | 52/DIG. 13 |
| 4,099,344 | 7/1978 | Ruemeli | 47/26 |
| 4,202,389 | 5/1980 | Ewald . | |
| 4,308,905 | 1/1982 | Gallagher . | |
| 4,498,912 | 2/1985 | Wagner | 52/233 |
| 4,615,181 | 10/1986 | Greenwood | 62/279 |
| 4,625,784 | 12/1986 | Boroson . | |
| 4,730,423 | 3/1988 | Hughes | 52/173 |
| 4,745,769 | 5/1988 | Wooden, Jr. | 62/259.1 |
| 4,953,328 | 9/1990 | Sewell et al. | 52/79.1 |
| 5,097,678 | 3/1992 | Aubuchon | 62/506 |
| 5,226,264 | 7/1993 | Walters | 52/63 |
| 5,244,264 | 9/1993 | Woodard | 312/100 |
| 5,294,195 | 3/1994 | Amr et al. | 312/236 |
| 5,307,849 | 5/1994 | Nelson . | |
| 5,341,860 | 8/1994 | Klein . | |
| 5,671,766 | 9/1997 | Williams | 135/87 |

FOREIGN PATENT DOCUMENTS

| | | | |
|---|---|---|---|
| 227505 | 10/1910 | Germany | 135/91 |

*Primary Examiner*—Beth A. Stephan
*Assistant Examiner*—Dennis L. Dorsey
*Attorney, Agent, or Firm*—Kenneth L Tolar

[57] ABSTRACT

The present invention relates to a substantially box-shaped cover for enclosing an outdoor air conditioning unit. The cover includes four vertical side walls and a top horizontal wall each constructed with a mesh type, solar screen material which allows air to flow therethrough while refracting sunlight. The box-shaped container is formed of two detachable, foldable components allowing the device to be disassembled and compactly folded for storage. Adjacent one or more bottom peripheral edges of the cover is a latch means for securing the device to the concrete foundation on which the outdoor air conditioner is typically supported. Furthermore, a decorative design element may be embossed or imprinted on the top wall or one or more sidewalls.

4 Claims, 2 Drawing Sheets

SUNLIGHT REFRACTIVE COVER FOR AN OUTDOOR AIR CONDITIONING UNIT

BACKGROUND OF THE INVENTION

The present invention relates to a cover for an air conditioner, and more specifically, a cover for an outdoor unit designed to shield it from sunlight without restricting air flow thereto.

DESCRIPTION OF THE PRIOR ART

Conventional outdoor air conditioning units typically include a housing having a compressor, condenser and various other components therein. A fan is also disposed within the housing and operates simultaneously with the compressor to assist in heat removal therefrom. However, because the unit is located outdoors, it is constantly being subjected to heat and sunlight. The heat and energy generated by the sun's rays impede the heat transfer rate from the compressor to the atmosphere resulting in less efficient cooling of the building interior. Accordingly, there is currently a need for a device which can effectively shield an outdoor air conditioning unit from direct sunlight.

Numerous air conditioner covers exist in the prior art. However, these devices generally relate to impermeable, rigid covers designed to protect the air conditioner from inclement weather and falling objects during the winter months while the air conditioner is not in use. Such devices are not suitable for covering the air conditioner while it is being used since air flow to the unit will be significantly obstructed. Other conventional air conditioner covers are designed for window-mounted units to minimize air leakage into the interior of a building during colder months. For example, U.S. Pat. No. 5,341,860 issued to Klein relates to a cover seal for a window mounted air conditioner.

U.S. Pat. No. 5,307,849 issued to Nelson discloses an outdoor air conditioner cover made from a resilient material to protect the unit from falling objects. The cover is made from a flexible and weather resistant material such as woven nylon fabric having a protective layer received therein for protecting the top of the unit from falling objects.

U.S. Pat. No. 4,625,784 issued to Boroson relates to a modular fabric cover for a window A/C unit designed to prevent ambient air from leaking into a room.

U.S. Pat. No. 4,308,905 issued to Gallagher discloses a window A/C cover designed to minimize air leakage.

U.S. Pat. No. 4,202,389 issued to Ewald relates to an A/C cover and sealing gasket for a window unit.

U.S. Pat. No. 2,720,236 issued to Hoffman discloses an A/C cover for a window unit.

The above described air conditioner covers will not adequately address the aforementioned need to repel sunlight from an active air conditioning unit. Most of the above described devices relate to a cover for a window mounted unit designed to seal any air leakage therearound. The device described in Nelson relates to a fabric cover for an outdoor unit having rigid upper layers for protecting the unit from falling objects or inclement weather. The cover cannot be used while the air conditioner is operating since it will greatly restrict air flow to the unit thereby inhibiting its performance. The present invention provides a uniquely configured device for covering an outdoor air conditioning unit which may be easily disassembled and folded for storage. Furthermore, the device includes solar screen outer walls which refract sunlight while allowing air to easily flow therethrough.

SUMMARY OF THE INVENTION

The present invention relates to a sunlight refractive cover for an outdoor air conditioning unit. The device comprises a substantially box-shaped enclosure having a horizontal top wall and four sidewalls vertically depending therefrom. Both the top walls and sidewalls include a substantially rectangular frame component that peripherally borders a rectangular mesh panel. The panel is made of a solar screen material. The cover is formed from two detachable, foldable components allowing the device to be disassembled and folded for storage. On the bottom peripheral edges of the cover is a latch means for securing the cover to the concrete foundation that typically supports the air conditioning unit. It is therefore an object of the present invention to provide a cover for an outdoor air conditioning unit which refracts sunlight therefrom.

It is yet another object of the present invention to provide a cover for an outdoor air conditioning unit which allows air to flow therethrough.

It is yet another object of the present invention to provide a cover for an outdoor air conditioning unit which may be conveniently disassembled and compactly folded for storage. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
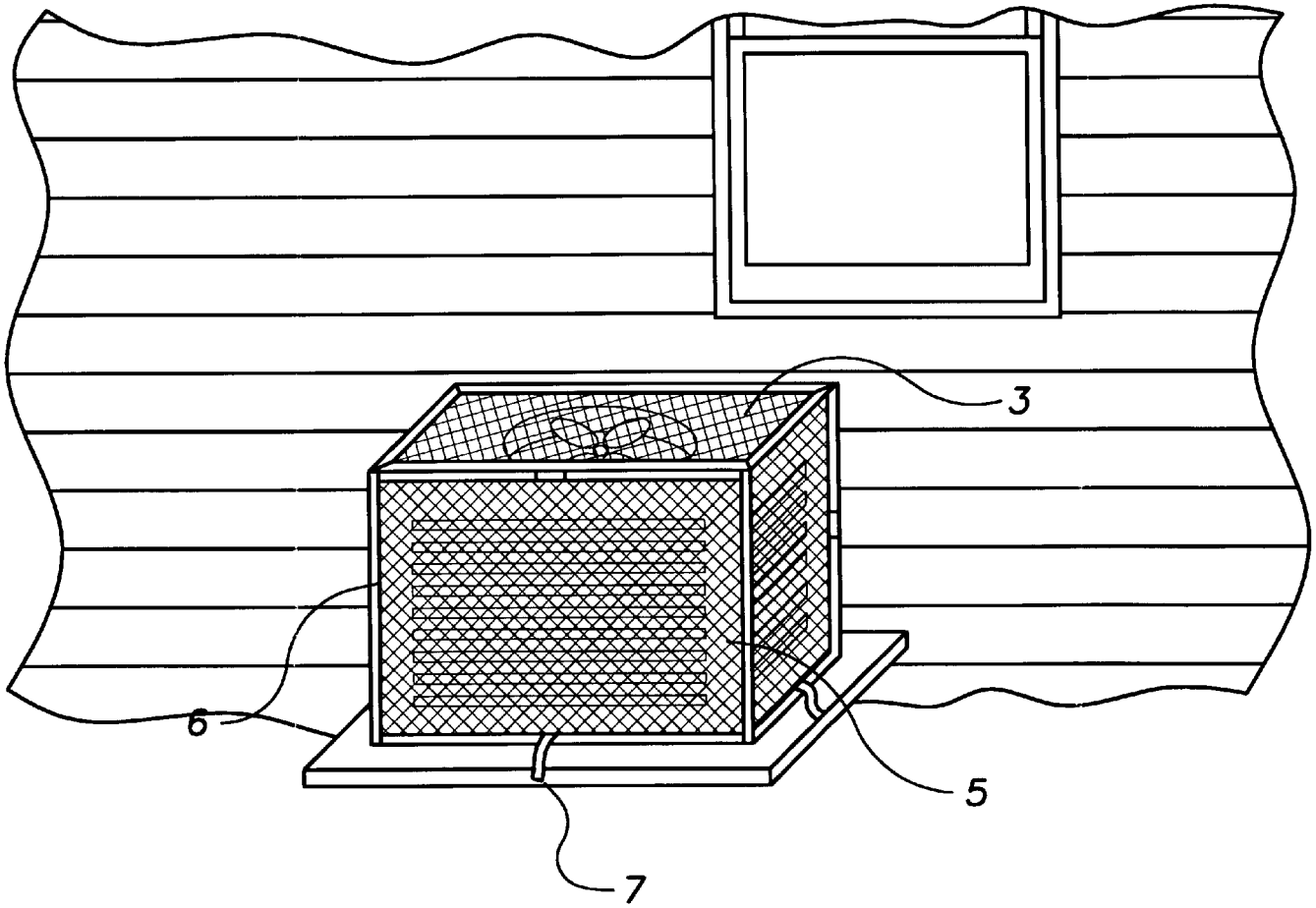
FIG. 1 depicts the inventive device surrounding an outdoor air conditioning unit.
Figure 2:
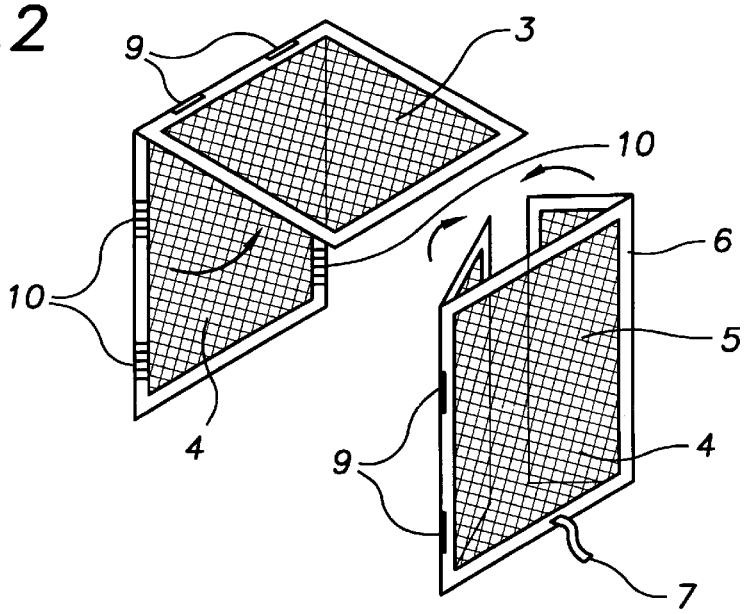
FIG. 2 depicts the two detachable components that form the cover according to the present invention.
Figure 3:
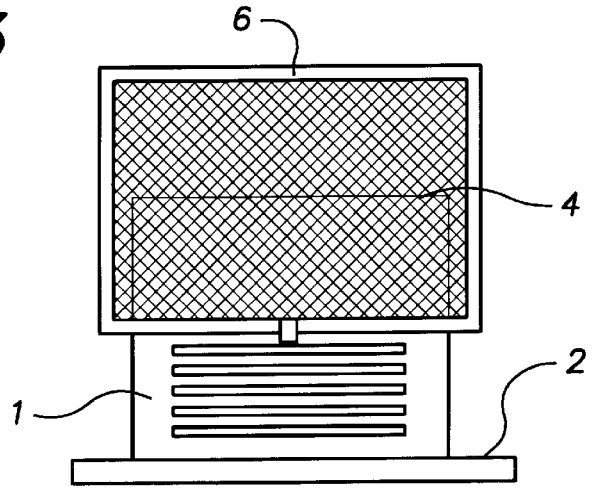
FIG. 3 depicts the inventive device partially covering an air conditioning unit.
Figure 4:
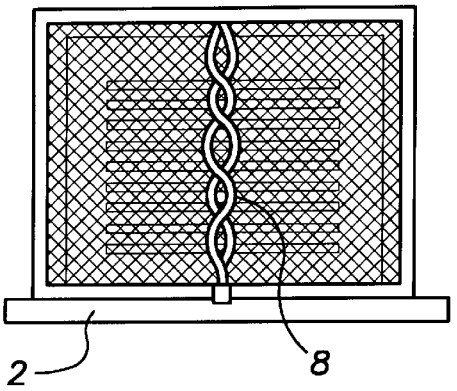
FIG. 4 depicts the inventive device with a decorative design thereon.

Referring now to FIGS. 1 through 3, the present invention relates to a permeable, collapsible cover for an outdoor air conditioning unit. An outdoor air conditioning unit typically includes a rectangular housing 1 having a fan, a compressor and various other components therein. The housing typically is supported on a rectangular concrete slab 2.

The present invention comprises a substantially box-shaped enclosure having a horizontal top wall 3, four sidewalls 4 vertically depending therefrom and an open bottom. The top wall and sidewalls define an interior chamber for receiving the air conditioner housing.

Each wall includes a substantially rectangular, mesh panel 5 peripherally bordered by a substantially rectangular frame member 6 for providing rigidity and structural integrity to the mesh panels. Accordingly, each wall has a bottom peripheral edge which abuts the upper surface of the slab, two opposing side edges and a top edge. The frame members 6 are preferably constructed with a lightweight aluminum or a similar equivalent. Each mesh panel 5 is preferably made from a solar screen material of the type generally known in the prior art. Such material is sometimes found on what are referred to as solar window screens which deflect sunlight from an exterior window.

A latch member 7 is attached edge of one or more sidewalls for surrounding and engaging the outer edge of the concrete slab. One or more screen panels may have any one of a plurality of decorative designs 8 thereon as depicted in FIG. 3.

Referring now to FIG. 3, the box-shaped cover preferably includes two detachable components allowing the device to be easily disassembled and compactly folded for storage. A first component includes a side wall with its top edge attached to a first edge of the top wall with a pair of hinges 9. On opposing edges of the sidewall frame member are a plurality of adhesive layers 10. The adhesive layers preferably relate to double-sided foam tape or a similar equivalent. On the remaining three edges of the top wall frame member are likewise a plurality of adhesive layers.

The second component includes the other three sidewalls. An intermediate sidewall has a wall hingedly engaging each of two opposing sides thereof. When assembling the device, the second component is unfolded such that the two opposing, hingedly engaging walls are perpendicular to the intermediate wall. The first component is unfolded such that its two walls are perpendicular. The second component may be quickly and easily attached to the first component by securing the adhesive layers on the first component sidewall to the free edges of the two opposing hinged walls of the second component. Likewise, the adhesive layers on the top wall may be secured to the top edges of the three sidewalls.

As described above, the frame members are preferably made from aluminum or a similar equivalent. However, as will be readily apparent to those skilled in the art, the shape, size and materials of construction of the various components may be varied without departing from the spirit of the present invention. Although a latch member is shown for securing the cover around an air conditioning unit, other suitable attachment means may also be used. Also, the shape of the cover may be varied to allow the device to cover air conditioning units having a circular or other cross-sectional configuration.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sunlight refractive cover for an air conditioning unit comprising:

a free standing enclosure dimensioned to receive and surround an air conditioning unit, said enclosure including a top wall, a plurality of sidewalls vertically depending therefrom and an open bottom, said top wall and said side walls each constructed with a solar screen material, each of said sidewalls having a bottom peripheral edge;

one of said side walls hingedly engaging said top wall to form a first component;

a second component formed by the remaining sidewalls, two of said remaining side walls hingedly engaging opposing sides of a third of said remaining side walls, said first component being removably attached to said second component to form a box-shaped, separable and collapsible cover.

2. A cover according to claim 1 wherein said first and second components are adhesively joined.

3. A cover according to claim 1 further comprising a latch means adjacent the bottom peripheral edge of at least one sidewall for frictionally engaging the outer edge of a concrete slab on which said air conditioner unit rests.

4. A cover according to claim 1 further comprising a decorative design element on at least one of said side walls.

* * * * *